United States Patent [19]

Luthi

[11] 4,251,927

[45] Feb. 24, 1981

[54] PAPER DRIER DRUM

[75] Inventor: Oscar Luthi, Nashua, N.H.

[73] Assignee: Ingersoll-Rand Company, Woodcliff Lake, N.J.

[21] Appl. No.: 104,152

[22] Filed: Dec. 17, 1979

[51] Int. Cl.[3] ..... F26B 13/30

[52] U.S. Cl. ..... 34/110; 34/115; 165/82; 432/251

[58] Field of Search ..... 432/103, 251; 34/108, 34/110, 115, 119, 124, 243 R; 165/82

[56] References Cited

U.S. PATENT DOCUMENTS 3,794,462 2/1974 Sylvest ..... 432/80

*Primary Examiner*—Larry I. Schwartz

*Attorney, Agent, or Firm*—Frank S. Troidl

[57] ABSTRACT

Hot gas is used to dry the paper on a rotatable drum. A plurality of spokes interconnect a rotatable shaft and the drum. The hot gas flows within the drum and directly contacts the spokes. The spokes extend tangentially from the shaft to the drum.

4 Claims, 6 Drawing Figures

PAPER DRIER DRUM

This invention relates to paper dryers. More particularly, this invention relates to paper dryers using a hot gas such as hot air which is either supplied to the drum or withdrawn from the drum through one or both ends of the drum.

In some paper drying applications, it is desirable to supply or withdraw the hot air through one or both ends of the drum. In order to do this, an open-spoke head is used. The spokes are in direct contact with the flowing hot air. The temperature of the hot air changes very quickly at start-up or in the case of a break in the paper web. Due to the direct contact of the hot air with the spokes the spokes will change their temperature faster than the rest of the drum head assembly. Serious thermal stresses and deflections of the spokes result.

This invention prevents serious thermal stress and deflections in the spokes by interconnecting the drum and a rotatable shaft used to rotate the drum with a plurality of spokes which extend tangentially from the shaft to the drum.

The invention, as well as its many advantages, may be further understood by reference to the following detailed description and drawings in which.

In the various figures, like parts are referred to by like numbers.

Figure 1:
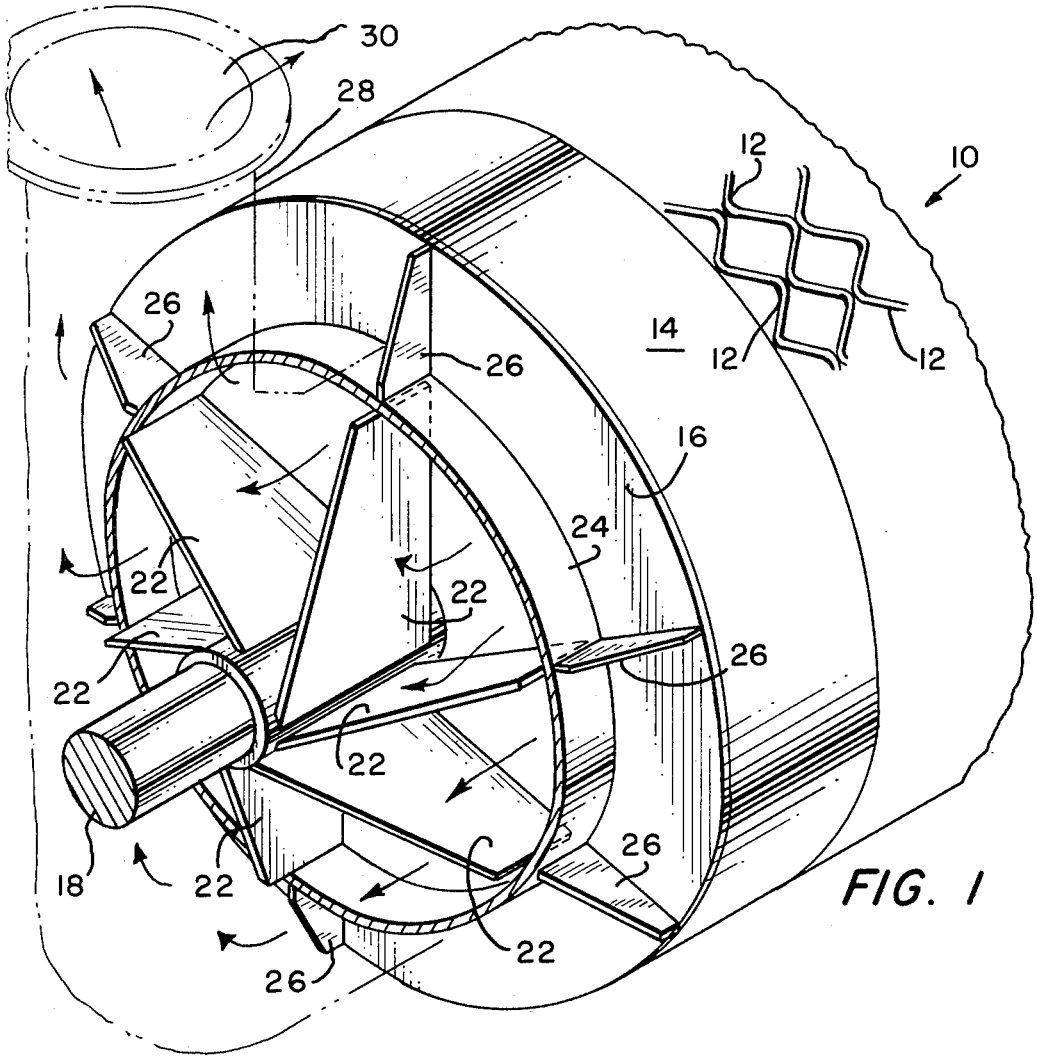
FIG. 1 is a fragmentary perspective view, partly in phantom, illustrating the invention.
Figure 2:
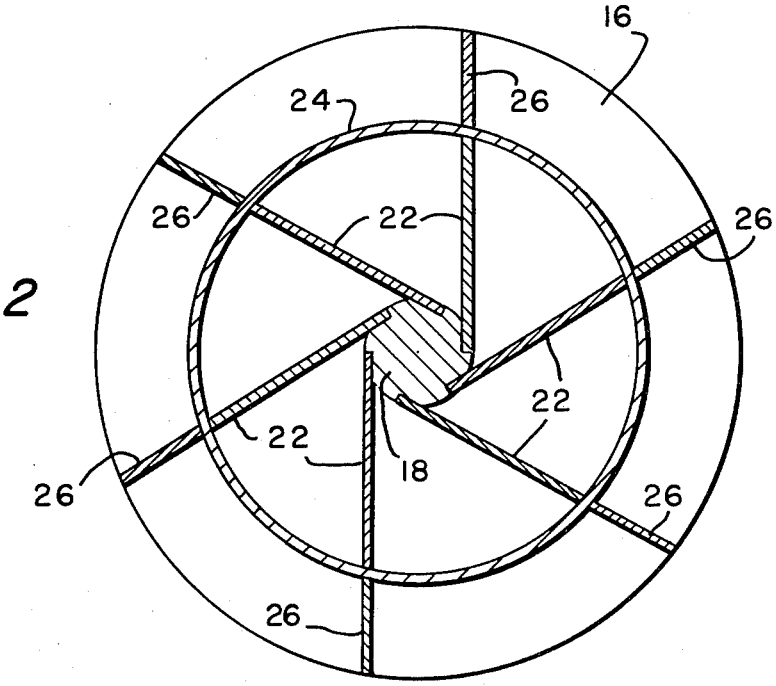
FIG. 2 is a sectional end view of FIG. 1.

Referring to the drawings, and more particularly to FIG. 1, the apparatus for drying paper with hot air comprises a rotatable drum 10. The drum is well suited for drying paper webs due to the large percentage of circumferential open area and structural rigidity.

The drum 10 includes the grid structure 12 which is supported by annular support 14, which is supported by head plate 16.

The drum 10 is rotated by a rotatable shaft 18. A plurality of spokes 22 extend from the shaft and are welded to annular ring 24. A plurality of braces 26 are welded to the annular ring 24 and extend from the annular ring 24 to the annular support 14 thus lending more rigidity to the end of the drum 10.

Hot air which has flowed through the paper web (not shown) being formed on the screen 12, is removed from the end of the drum 10. The hot air flow is indicated by the arrows in FIG. 1. The hot air comes in direct contact with the spokes 22 and flows from the spokes 22 through a gas conduit 28 having an outlet 30.

The temperature of the hot air can change very quickly. Such changes, for example, occur at start-up or if the paper web breaks and may amount to a differential temperature of 300° F., or more. The spokes 22 being in close contact with the hot air will change their temperature faster than the rest of the end assembly, such as members 24, 16, and 14. Serious thermal stresses and deflections of the spokes result.

In this invention, the spokes 22 interconnecting the shaft 18 and the drum extend tangentially from the shaft 18 to the annular ring 24. Spokes 22 must be strong enough to support large radial loads and to transmit the shear force and bending moment due to the bearing reaction. The spokes are straight along their entire length and six to twelve spokes, or more, are used. Also, the drive and braking torque must be transmitted by the spokes. However, the spokes must also be flexible enough to take temperature shocks of 300° F. or more. The spokes 22 in their thermally expanded position will cause the center shaft to "wind-up" by an angle $=dl/r$ where dl is the change in length of each spoke 22 and r is the radius of the rotatable shaft 18. Only a minimum bending stress will occur in the spokes because of the small spoke thickness.

Figure 3:
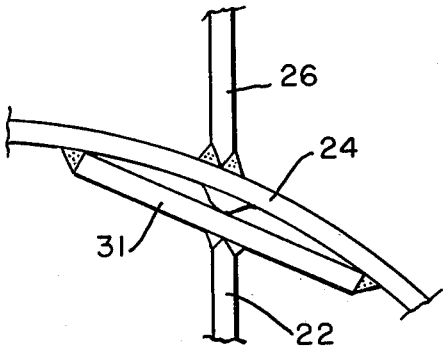
FIG. 3 shows a doubler plate flexible connection.
Figure 4:
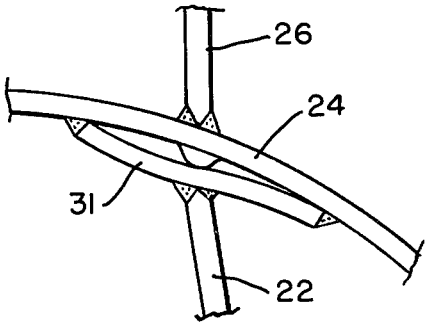
FIG. 4 shows a doubler plate connection of FIG. 3, in the expanded position.

If desired, a doubler plate 31 as shown in FIG. 3 and FIG. 4, may be used to connect the spokes 22 to the annular ring 24. FIG. 3 shows the doubler plate in the normal position; FIG. 4 shows the doubler plate in the expanded position (exaggerated). The doubler plate 31 is welded to the spokes 22 and braces 26, as indicated. The doubler plate further increases the flexibility of the spokes.

Figure 5:
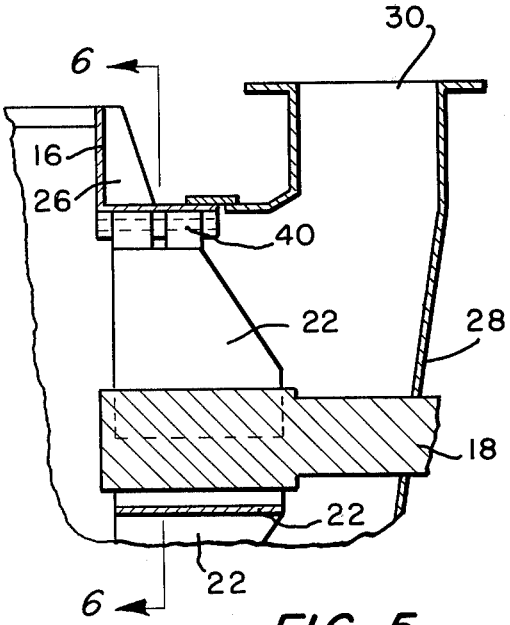
FIG. 5 is a fragmentary sectional view showing a second embodiment of the invention and FIG. 6 is a view taken along lines 6—6 of FIG. 5 and in the direction of the arrows.
Figure 6:
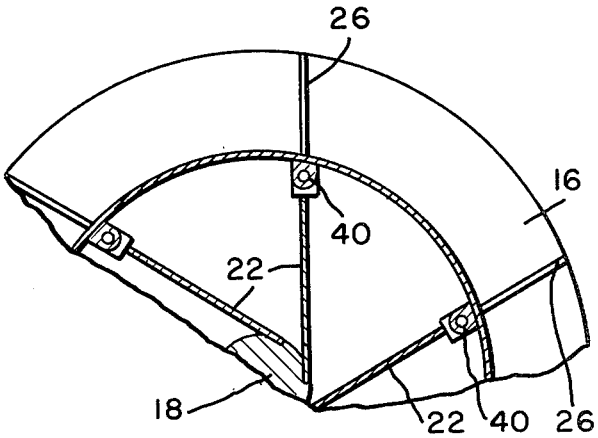

In the embodiment shown in FIG. 5 and FIG. 6, instead of the doubler plate, a hinge 40 interconnects the spokes 22 with the annular ring 24.

In all embodiments shown, the hot air used to dry the paper web is withdrawn from drum 10 through the end of the drum 10. The hot air flows past spokes 22, into hot air gas conduit 28, and out of outlet 30. If, for some reason, such as a sudden tear in the paper mat, the temperature changes, the flexible spokes 22 in each embodiment will expand, causing a slight wind-up of the rotatable shaft 18. However, the spokes 22 will not break as easily as is the case with conventional paper dryers having spokes which extend radially from the rotatable shaft.

The flexible spokes could be used either at one end of the drum, as shown, or at both ends. Also, if desired, rather than remove hot air from the drum, hot air could be flowed into the drum and then removed through the paper mat.

I claim:

1. An apparatus for drying paper with hot gas comprising: a drum; a coaxial rotatable shaft; a plurality of spokes interconnecting the shaft and the drum; and a hot gas flow path including hot gas flowing within the drum and also directly contacting the spokes; said spokes being tangentially related to the shaft and extending from the shaft to the drum so as to allow for expansion of said spokes without deformation of said drum.

2. An apparatus in accordance with claim 1 wherein: the outer ends of the spokes are attached to the drum by a doubler plate.

3. An apparatus in accordance with claim 1 wherein: the outer ends of the spokes are attached to the drum by a hinged connection.

4. An apparatus in accordance with claim 1 wherein: the spokes are straight along their entire length.

* * * * *